US009993082B2

(12) United States Patent
Choi

(10) Patent No.: US 9,993,082 B2
(45) Date of Patent: Jun. 12, 2018

(54) CHAIR FRAME STRUCTURE OF FOLDABLE CHAIR

(71) Applicant: Campvalley (Xiamen) Co., Ltd., Xiamen (CN)

(72) Inventor: Kwanjun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days. days.

(21) Appl. No.: 15/042,514

(22) Filed: Feb. 12, 2016

(65) Prior Publication Data

US 2016/0296023 A1 Oct. 13, 2016

(30) Foreign Application Priority Data

Feb. 13, 2015 (CN) ..... 2015 2 0105108 U

(51) Int. Cl.
*A47C 4/28* (2006.01)

(52) U.S. Cl.
CPC ..... *A47C 4/286* (2013.01)

(58) Field of Classification Search
CPC ..... A47C 4/286
USPC ..... 297/42
See application file for complete search history.

(56) References Cited

U.S. PATENT DOCUMENTS

| | | | | |
|---|---|---|---|---|
| 291,062 | A * | 1/1884 | Latour | 297/42 |
| 2,459,843 | A | 1/1949 | Scholander | |
| 2,712,349 | A | 7/1955 | Le Voir | |
| 3,093,407 | A | 6/1963 | Wilson | |
| 5,356,107 | A | 10/1994 | Sinohuiz | |
| 5,501,505 | A | 3/1996 | Jablonski | |
| 5,527,089 | A | 6/1996 | Charest | |
| 5,620,227 | A | 4/1997 | Brune | |
| 5,851,052 | A | 12/1998 | Gustafsson | |
| 5,893,605 | A | 4/1999 | Chang | |
| 6,082,813 | A | 7/2000 | Chen | |
| 6,179,374 | B1 | 1/2001 | Tang | |
| 6,247,749 | B1 | 6/2001 | Yu | |
| 6,302,479 | B1 | 10/2001 | Zheng | |
| 6,322,646 | B1 | 11/2001 | Chakrabarti et al. | |
| 6,634,705 | B1 | 10/2003 | Zheng | |
| 6,752,414 | B1 | 6/2004 | Waldron et al. | |
| 6,840,573 | B1 | 1/2005 | Yao | |

(Continued)

FOREIGN PATENT DOCUMENTS

| | | |
|---|---|---|
| CN | 201480624 U | 5/2010 |
| DE | 195 40 528 A1 | 5/1996 |
| WO | WO 2005/112703 A1 | 12/2005 |

*Primary Examiner* — Anthony D Barfield
(74) *Attorney, Agent, or Firm* — Morgan, Lewis & Bockius LLP

(57) ABSTRACT

Disclosed are chair frames and foldable chairs. A chair frame includes left and right side frames, each having a front leg, a rear leg, a backrest rod, a seat rod, and a connecting piece. The backrest rod and the seat rod are pivotally connected to the rear leg. The front leg is pivotally connected to the connecting piece movably disposed on the rear leg. The chair frame also includes a pair of cross front supporting rods and a pair of cross rear supporting rods. Each front supporting rod is pivotally connected to the front leg of one side frame and pivotally connected to the seat rod of the other side frame. Each rear supporting rod is pivotally connected to the rear leg of one side frame and pivotally connected to the front leg of the other side frame.

16 Claims, 7 Drawing Sheets

(56) References Cited

U.S. PATENT DOCUMENTS

| | | | | |
|---|---|---|---|---|
| 6,926,356 | B2 * | 8/2005 | Chen | A47C 4/286 297/45 X |
| 7,011,372 | B1 | 3/2006 | Hsieh | |
| 7,404,601 | B2 | 7/2008 | Chen | |
| 7,717,502 | B2 * | 5/2010 | Deng | A47C 4/20 297/42 X |
| 7,717,503 | B1 | 5/2010 | Watson | |
| 7,758,111 | B2 | 7/2010 | Chen | |
| 8,100,469 | B2 | 1/2012 | Lougee | |
| 8,303,032 | B1 | 11/2012 | Platta | |
| 8,465,090 | B1 | 6/2013 | O'Connor | |
| 8,511,747 | B2 | 8/2013 | Lougee | |
| 9,204,729 | B2 | 12/2015 | Frankel | |
| 2002/0024240 | A1 * | 2/2002 | Chen | A47C 4/286 297/42 X |
| 2004/0135405 | A1 * | 7/2004 | Zheng | A47C 4/00 297/42 |
| 2006/0249991 | A1 | 11/2006 | Hsieh | |
| 2010/0237665 | A1 | 9/2010 | Grace | |
| 2010/0308042 | A1 | 12/2010 | Faris | |
| 2011/0248037 | A1 | 10/2011 | Fung | |
| 2011/0248040 | A1 | 10/2011 | McGregor | |
| 2011/0303659 | A1 | 12/2011 | Perlman | |
| 2013/0264340 | A1 | 10/2013 | Zens | |
| 2016/0296023 | A1 | 10/2016 | Choi | |

* cited by examiner

CHAIR FRAME STRUCTURE OF FOLDABLE CHAIR

CROSS-REFERENCE TO RELATED APPLICATIONS

This application claims priority to Chinese Application No. 201520105107.8, filed Feb. 13, 2015, which is incorporated herein by reference in its entirety.

FIELD OF THE UTILITY MODEL

The present utility model relates to an article for daily use, in particular to a chair frame structure of a foldable chair.

BACKGROUND OF THE UTILITY MODEL

Due to the feature that a foldable chair is portable and foldable, not only can the movement be facilitated, but also the space is saved. Therefore, the foldable chair is widely used at places such as various training organizations, schools at all levels, public places, hospitals, restaurants, hotels, companies and families. A commonly seen foldable chair comprises a chair frame, a chair seat and a chair backrest and can be folded on the whole.

Taking a beach chair frame disclosed with publication number CN201480624 as an example, referring to FIG. 1, the beach chair frame comprises a left backrest pipe 11', a right backrest pipe 12', a left seat cushion pipe 21', a right seat cushion pipe 22', a left armrest pipe 31', a right armrest pipe 32', a left rear leg pipe 41', a right rear leg pipe 42' and rear cross pipes 5', wherein front portions of the left seat cushion pipe 21' and the right seat cushion pipe 22' are movably connected with upper portions of the left armrest pipe 31' and the right armrest pipe 32', rear portions of the left seat cushion pipe 21' and the right seat cushion pipe 22' are movably connected with the left rear leg pipe 41' and the right rear leg pipe 42', the middle-rear portions of the left seat cushion pipe 21' and the right seat cushion pipe 22' are movably connected with the left backrest pipe 11' and the right backrest pipe 12', bottom portions of the left armrest pipe 31' and the right armrest pipe 32' are movably connected with bottom portions of the right backrest pipe 12' and the left backrest pipe 11', a middle portion of the left armrest pipe 31' is crossly and movably connected with a middle portion of the right armrest pipe 32', top portions of the left rear leg pipe 41' and the right rear leg pipe 42' are movably connected with the left backrest pipe 11' and the right backrest pipe 12', a left sliding sleeve 61' and a right sliding sleeve 62' are arranged at connecting positions, the left sliding sleeve 61' and the right sliding sleeve 62' are nested in the left backrest pipe 11' and the right backrest pipe 12', and armrest limiting sleeves 71' and 72' are arranged at upper portions of the left sliding sleeve and the right sliding sleeve. Bottom portions of the left rear leg pipe 41' and the right rear leg pipe 42' are respectively and movably connected with the bottom portions of the left and right sides of the rear cross pipes, and the top portions of the left and right sides of the rear cross pipes are respectively and movably connected with the left and right backrest pipes. By adopting movable connecting structures at connecting positions between components, the beach chair frame can be unfolded and folded.

For the foldable chair frame structure with the above-mentioned structure, since the backrest pipes are fixed and are simultaneously used as front supporting legs to form front leg pipes, the backrest pipes and the front leg pipes are integral, the upper portions used as a backrest can only be in parallel with the supporting leg portions below and a certain inclination angle needs to be kept, the elevation angle of the backrest is a certain fixed angle, the effect of comfortably resting on the backrest cannot be achieved and the sitting comfortableness of the foldable chair frame is not good.

SUMMARY OF THE UTILITY MODEL

The purpose of the present utility model is to provide a chair frame structure of a foldable structure, wherein a chair frame is convenient to fold and use and has a comfortable resting backrest after being unfolded.

In order to achieve the above-mentioned purpose, the present utility model adopts the following solution:

A chair frame structure of a foldable chair comprises a supporting leg fame and seat rods and backrest rods which are connected thereon, wherein the supporting leg frame comprises side supports on two sides and cross supporting rod groups on front and rear facades, each side support comprises a front supporting leg which is rearwards and obliquely supported and a rear supporting leg which is crossly supported at an upper portion of the front supporting leg; after the rear portions of the seat rods are pivotally connected with the front supporting legs, rear ends thereof are pivotally connected onto the rear supporting legs; a backrest rod is pivotally connected onto each rear supporting leg, a connecting piece which can slide upwards is arranged on the backrest rod, and an upper end of the front supporting leg is pivotally connected onto the connecting piece; in the rear facade, lower ends of two cross supporting rods between the two rear supporting legs are respectively connected onto the rear supporting legs, and upper ends thereof are pivotally connected onto the upper ends of the front supporting legs; and in the front facade, lower ends of two cross supporting rods are respectively and pivotally connected below the front supporting legs, and upper ends thereof are pivotally connected at the front of the seat rods.

Further, each supporting rod in the front facade is connected onto the seat rod and then is upwards extended to form an armrest rod.

Further, a tail end of the armrest rod is outwards extended to form an armrest section.

Further, at least one connecting strip is pivotally connected above each rear supporting leg and is connected with the corresponding front supporting leg, and the other end of the connecting strip is connected to the front supporting leg.

Further, a pair of connecting strips are pivotally connected above each rear supporting leg, and the two connecting strips which are arranged in parallel are connected onto the two sides of the corresponding front supporting leg and the rear supporting leg.

Further, the rear supporting legs forwards support the front supporting legs, and the upper ends of the rear supporting legs are provided with rest-fitting grooves for resting the front supporting legs.

By adopting the above-mentioned structure, in the present utility model, since the backrest rods are located at the rear of the front supporting legs and the rear supporting legs which are crossly supported and a certain elevation angle is formed between the backrest rods and the seat rods, a resting surface with a certain elevation angle is formed at the rear of the seat surface; since the backrest rods are separately designed and connected into the chair frame to fit the angle needed for resting, the chair frame can be unfolded on the whole and a comfortable sitting posture can be obtained during use. In addition, the chair frame can be unfolded or folded to a small volume on the whole and thereby is convenient to use.

DETAILED DESCRIPTION OF THE EMBODIMENTS

In order to further explain the technical solution of the present utility model, the present utility model will be described below in detail through specific embodiments.

Figure 1:
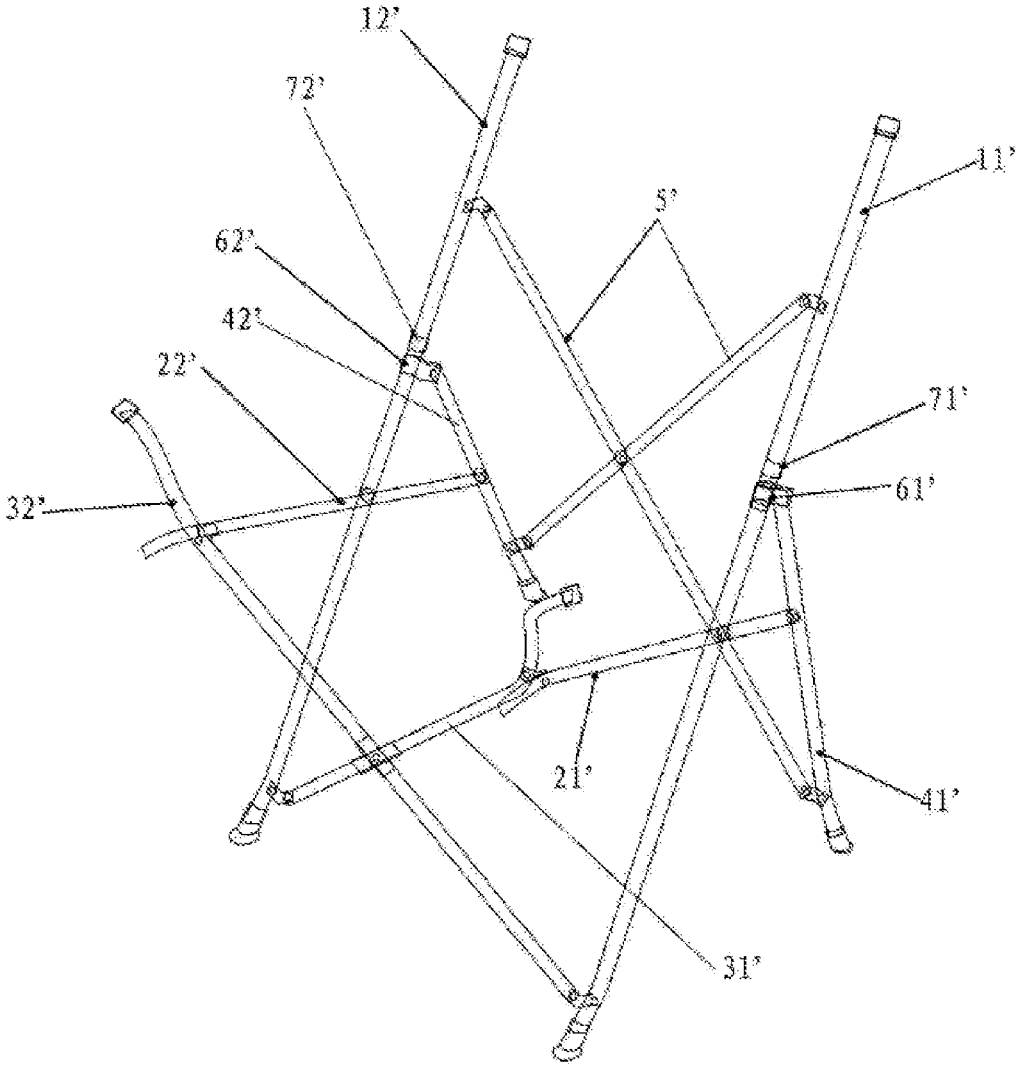
Fig. 1 (Related Art)
FIG. 1 is a stereoscopic schematic diagram of a chair frame in the prior art.
Figure 2:
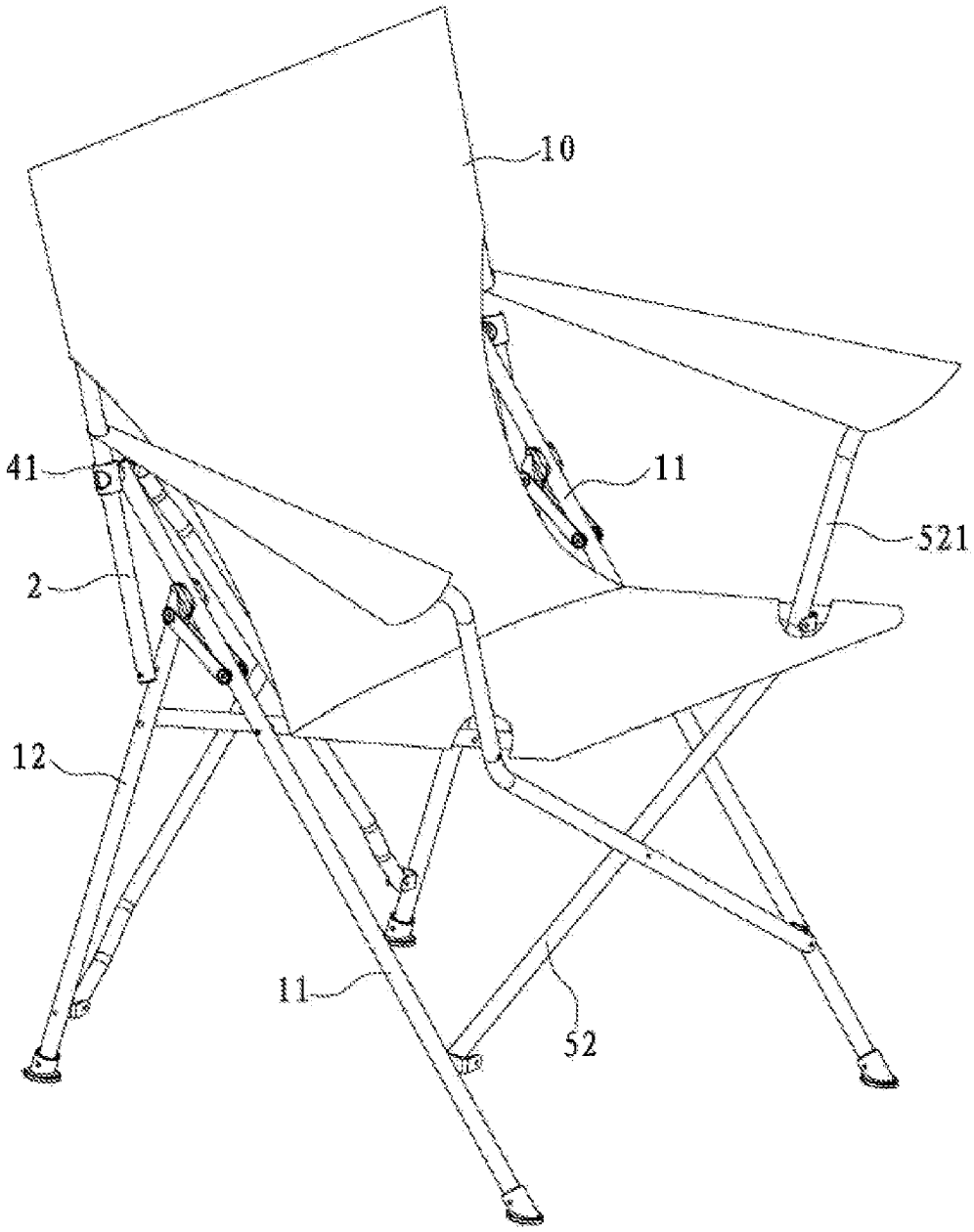
FIG. 2 is a view of the present utility model in a used state.

As shown in FIG. 2, in a chair frame structure of a foldable chair provided by the present utility model, a chair cloth 10 is connected thereon during use and the chair cloth forms a seat cloth, a backrest cloth and armrest cloths according to the supporting pattern of the chair frame.

Figure 3:
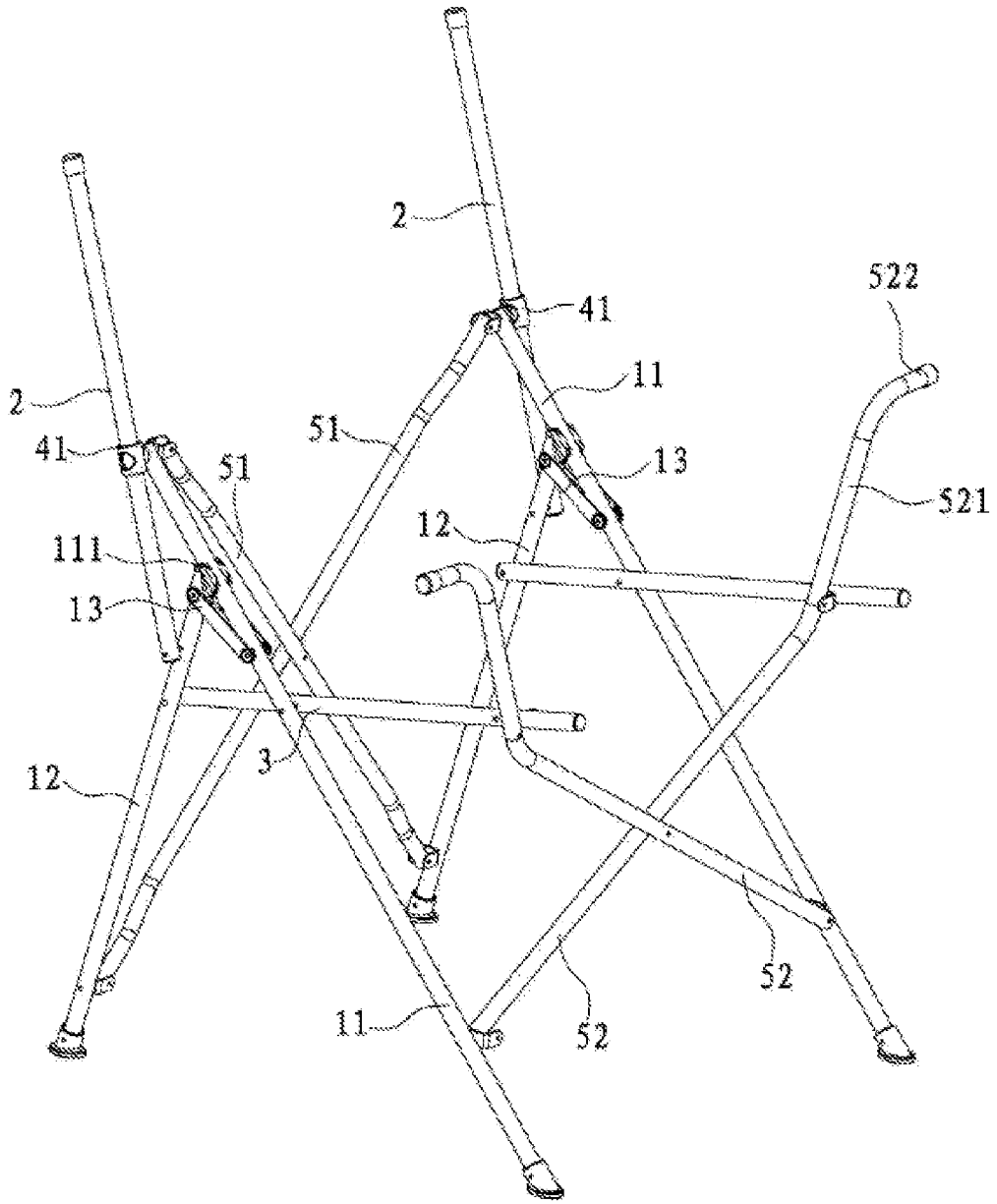
FIG. 3 is a stereoscopic schematic diagram of the present utility model in an unfolded state.
Figure 4:
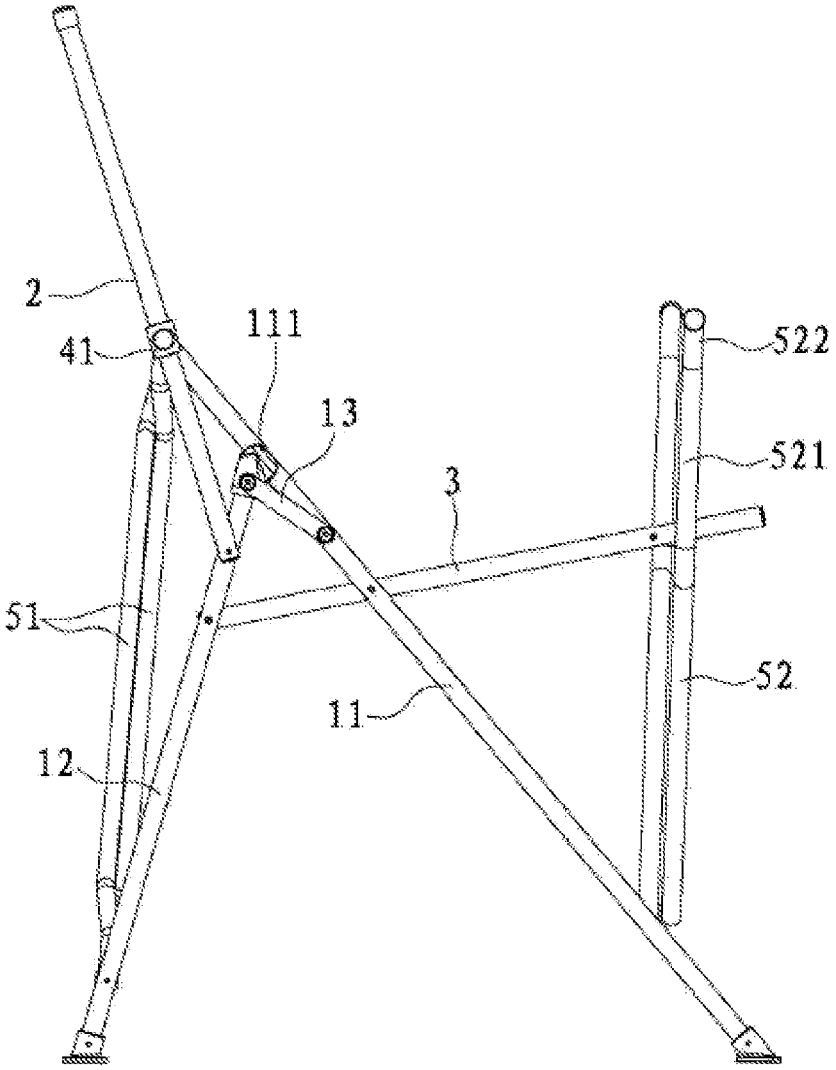
FIG. 4 is a side schematic diagram of the present utility model in an unfolded state.

In combination with FIGS. 2 and 3, the chair frame structure of the foldable chair comprises a supporting leg fame and seat rods and backrest rods which are connected thereon, wherein the supporting leg frame comprises side supports on two sides and cross supporting rod groups on front and rear facades, each side support comprises a front supporting leg 11 and a rear supporting leg 12, the front supporting leg 11 is rearwards and obliquely supported, the rear supporting leg forwards support the upper portion of the front supporting leg, the front supporting leg and the rear supporting leg are crossly supported, and the upper end of the rear supporting leg 12 can be provided with a rest-fitting groove 111 for resting the front supporting leg 11. At least one connecting strip 13 is further pivotally connected at a position above the rear supporting leg 12 and is connected to the front supporting leg 11. In this embodiment, a pair of connecting strips 13 are provided, the two connecting strips 13 which are arranged in parallel are connected onto the two sides of the front supporting leg 11 and the rear supporting leg 12, and the other ends of the connecting strips 13 are connected onto the front supporting leg 11. When the chair frame is folded, the front supporting leg 11 leaves the support of the rear supporting leg, and the front supporting leg and the rear supporting leg are folded together under the connecting effect of the connecting strips in cooperation with the folding of the chair frame.

The backrest rods 2 are pivotally connected onto the rear supporting legs 12, the seat rods 3 which are used for connecting the seat cloth are simultaneously and pivotally connected onto the front supporting legs 11 and the rear supporting legs 12, the seat rods 3 are pivotally connected to the inner sides of the front supporting legs 11 and the rear supporting legs 12, the rear portions of the seat rods 3 are pivotally connected with the front supporting legs 11 and then the rear ends of the seat rods 3 are pivotally connected onto the rear supporting legs 12. The lower ends of the backrest rods 2 are also pivotally connected above the rear supporting legs 12, and simultaneously the top ends of the front supporting legs 11 are enabled to be also connected onto the backrest rods 2. Thus, each backrest rod 2 is connected between the two supporting legs and has a slightly rearward elevation angle, a certain included angle is formed between each backrest rod 2 and the corresponding seat rod 3 which is transversely horizontal, and a resting surface with a certain elevation angle can be obtained above the seat surface. Moreover, a connecting piece 41 which can slide upwards is arranged on each backrest rod 2 and the upper end of the front supporting leg 11 is pivotally connected onto the connecting piece 41.

Cross supporting rod groups are arranged in the front facade and the rear facade of the chair frame, a cross supporting rod group is connected between the two rear supporting legs 12, the lower ends of two cross supporting rods 51 in the cross supporting rod group are respectively and pivotally connected onto the rear supporting legs 12, the upper ends are respectively connected onto the backrest rods 2, the upper ends of the supporting rods 51 are pivotally connected onto the upper ends of the front supporting legs 11, and thus the upper ends of the front supporting legs 11 together with the upper ends of the supporting rods 51 are pivotally connected onto the connecting pieces 41. A cross supporting rod group is also arranged in the front facade of the chair frame and comprises two cross supporting rods 52 in the front facade, the lower ends of the supporting rods 52 are respectively and pivotally connected below the front supporting legs 11, and the upper ends of the supporting rods 52 are pivotally connected at the front of the seat rods 3. Further, in order to form armrests in the chair frame, each supporting rod 52 in the front facade is connected onto the seat rod 3 and then is upwards extended to form an armrest rod 521, the tail end of each armrest rod 521 can also be outwards extended to form an armrest section 522 to rest a hand during sitting and resting, an armrest cloth can be outwards extended from each backrest rod 2 and be connected into the armrest section 522 and thus armrests on the two sides of the chair frame are formed.

Figure 5:
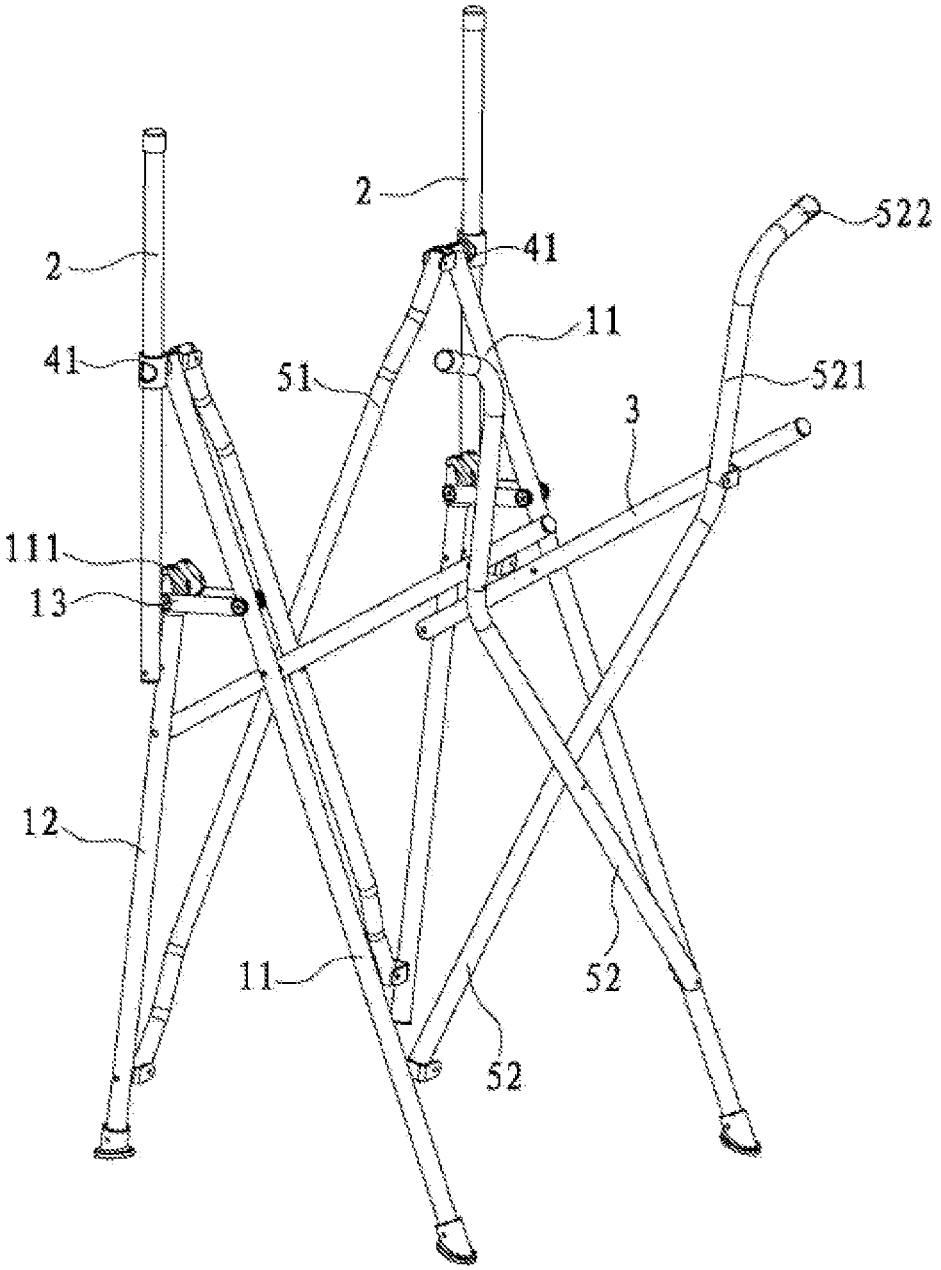
FIG. 5 is a stereoscopic schematic diagram of the present utility model in a semi-folded state.
Figure 6:
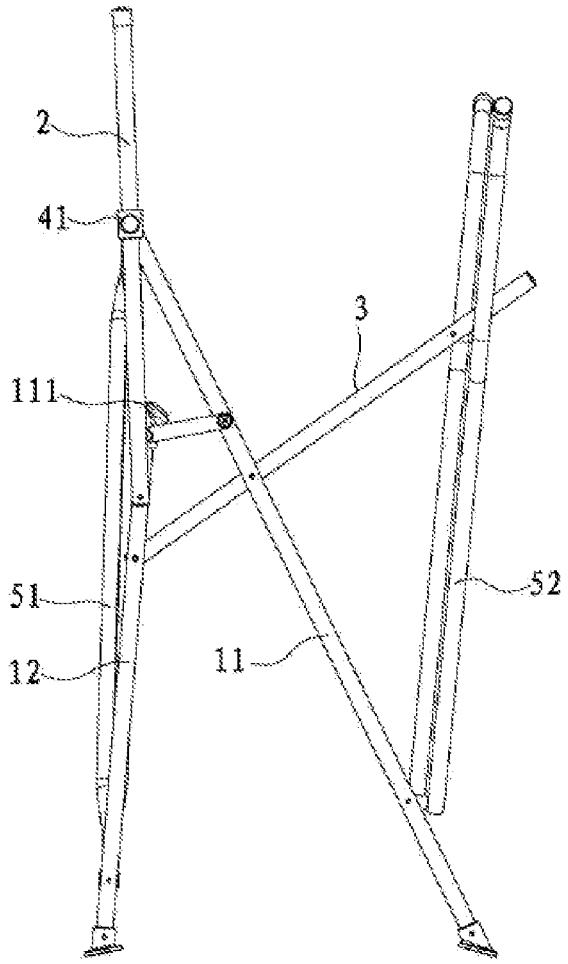
FIG. 6 is a side schematic diagram of the present utility model in a semi-folded state.
Figure 7:
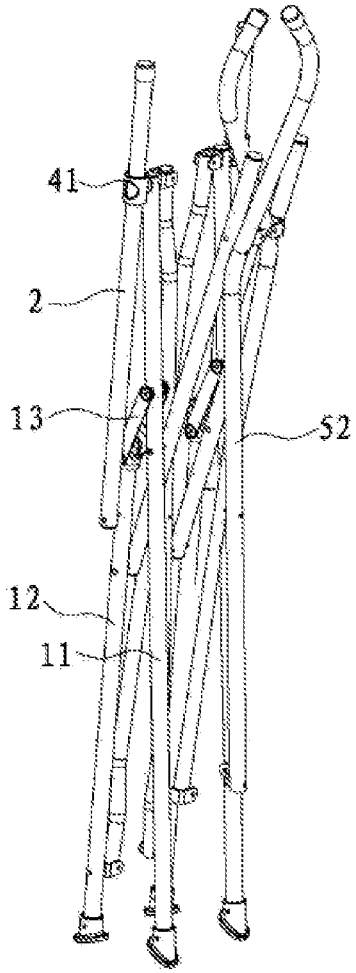
FIG. 7 is a stereoscopic schematic diagram of the present utility model in a folded state.
Figure 8:
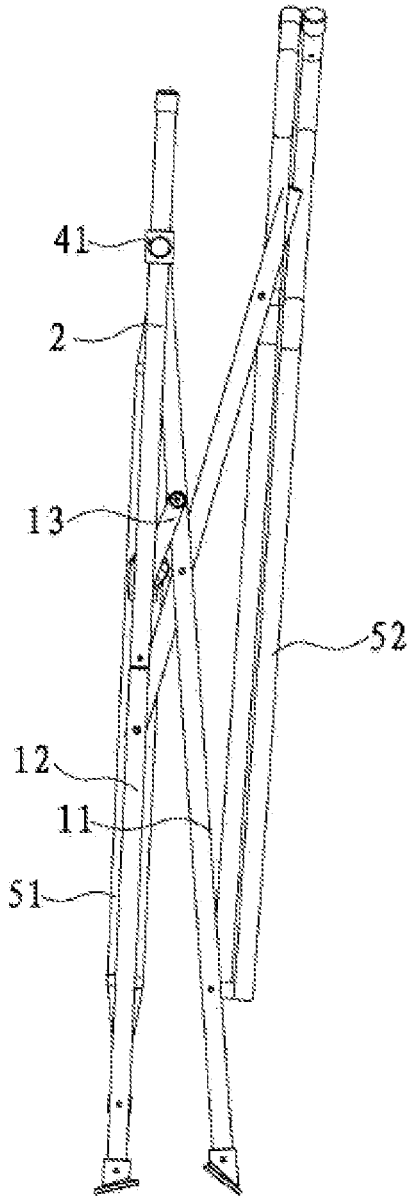
FIG. 8 is a side schematic diagram of the present utility model in a folded state.

By movably connecting all rods, when the chair frame disclosed by the present utility model is folded, as shown in FIGS. 2-8, firstly the rear supporting legs 12 which are obliquely supported are enabled to leave the support of the front supporting legs 11 and are rest-fit in parallel towards the direction of the backrest rods 2, then the front supporting legs 11 are rest-fit towards the rear supporting legs 12, and the front supporting legs 11 and the rear supporting legs 12 are pivotally connected and move on the connecting strips 13. In the rest-fitting process, the cross supporting rod groups in the front facade and the rear facade are also folded and rest-fit, the connecting pieces 41 upwards move on the backrest rods 2, and the seat rods 3 together with the supporting rods 52 in the front facade are also folded upwards and towards the direction of the backrest rods 2, as shown in FIG. 5. Finally, the front supporting legs 11 together with the seat rods 3 and the folded supporting rods 51 and 52 upwards move and then are rearwards folded, and thus the entire centralization and folding process is completed, as shown in FIG. 7. Contrarily, the seat rods, the armrest rods and the front supporting legs are directly unfolded, further the cross supporting rod groups are unfolded, the rods are unfolded in a linked manner, the chair frame can be unfolded to take a supporting effect in use, and the chair frame can also be easily folded and rest-fit or unfolded and is convenient to use.

By adopting the chair frame structure of the foldable chair disclosed by the present utility model, since the backrest rods 2 are located at the rear of the front supporting legs 11 and the rear supporting legs 12 which are crossly supported and a certain elevation angle is formed between the backrest rods 2 and the seat rods 3, a resting surface with a certain elevation angle is formed at the rear of the seat surface; since the backrest rods 2 are separately designed and connected into the chair frame to fit the angle needed for resting, the chair frame can be unfolded on the whole and a comfortable sitting posture can be obtained during use. In addition, since the front and rear supporting legs, the seat rods, the backrest rods and the cross supporting rod groups in the front and rear facades are connected together in a linked manner, the seat rods are cooperatively folded and rest-fit to the front of the backrest rods during folding, the front facade of the chair frame is directly rearwards folded, all rods of the chair frame are enabled to be folded compactly, the volume of the folded chair frame is small, and the storage and transportation are more favorably facilitated.

The above-mentioned embodiments and drawings are not used for limiting the product form and pattern of the present utility model. All proper changes or modifications made by one skilled in the art thereto shall be considered to fall into the patent range of the present utility model.

The invention claimed is:

1. A chair frame of a foldable chair, comprising:

left and right side frames at left and right sides of the chair frame, each comprising:

a rear leg having an upper end;

a backrest rod having a lower end pivotally connected to the rear leg at a fixed first pivotal point below the upper end of the rear leg when the chair frame is unfolded;

a connecting piece disposed on the backrest rod and movable along the backrest rod;

a seat rod having a rear end pivotally connected to the rear leg at a fixed second pivotal point below the upper end of the rear leg when the chair frame is unfolded, wherein the second pivotal point is below the first pivotal point;

a front leg having an upper end pivotally connected to the connecting piece and a middle portion pivotally connected to the seat rod at a third pivotal point, wherein when the chair frame is unfolded, an upper portion of the front leg between the upper end of the front leg and the third pivotal point abuts the upper end of the rear leg;

a pair of cross front supporting rods disposed between the left and right side frames at a front side of the chair frame, wherein each front supporting rod has a lower end pivotally connected to a lower portion of the front leg of one side frame, and an upper portion pivotally connected to a front portion of the seat rod of the other side frame at a fourth pivotal point; and a pair of cross rear supporting rods disposed between the left and right side frames at a rear side of the chair frame, wherein each rear supporting rod has a lower end pivotally connected to a lower portion of the rear leg of one side frame and an upper end pivotally connected to the upper end of the front leg of the other side frame.

2. The chair frame of claim 1, wherein each of the left and right side frames further comprises at least one connecting strip having one end pivotally connected to the rear leg and the other end pivotally connected to the front leg.

3. The chair frame of claim 1, wherein each of the left and right side frames further comprises at least one connecting strip having one end pivotally connected to the rear leg at a location between the upper end of the rear leg and the first pivotal point, and the other end pivotally connected to the front leg at a location between the upper end of the front leg and the third pivotal point.

4. The chair frame of claim 1, wherein each of the left and right side frames further comprises two connecting strips parallel to each other, each connecting strip having one end pivotally connected to the rear leg and the other end pivotally connected to the front leg.

5. The chair frame of claim 1, wherein the upper end of the rear leg is formed with a groove for receiving the front leg when the chair frame is unfolded.

6. The chair frame of claim 1, wherein the second pivotal point is below the first pivotal point when the chair frame is unfolded.

7. A foldable chair, comprising:

a chair frame of claim 1; and a chair cloth coupled to the chair frame.

8. The foldable chair of claim 7, wherein the chair cloth comprises a backrest cloth, a seat cloth and armrest cloths, and is coupled to the backrest rods, seat rods and the upper portions of the front supporting rods of the left and right side frames.

9. The foldable chair of claim 7, wherein when the chair frame is unfolded, the upper portion of each front supporting rod extends upward, outward, or upward and outward, beyond the fourth pivotal point, the extended upper serving as an armrest.

10. The foldable chair of claim 7, wherein each of the left and right side frames further comprises at least one connecting strip having one end pivotally connected to the rear leg and the other end pivotally connected to the front leg.

11. The foldable chair of claim 7, wherein each of the left and right side frames further comprises at least one connecting strip having one end pivotally connected to the rear leg at a location between the upper end of the rear leg and the first pivotal point, and the other end pivotally connected to the front leg at a location between the upper end of the front leg and the third pivotal point.

12. The foldable chair of claim 7, wherein each of the left and right side frames further comprises two connecting strips parallel to each other, each connecting strip having one end pivotally connected to the rear leg and the other end pivotally connected to the front leg.

13. The foldable chair of claim 7, wherein each of the left and right side frames further comprises two connecting strips parallel to each other, each connecting strip having one end pivotally connected to the rear leg and the other end pivotally connected to the front leg.

14. The foldable chair of claim 7, wherein the upper end of the rear leg is formed with a groove for receiving the front leg when the chair frame is unfolded.

15. The foldable chair of claim 7, wherein the second pivotal point is below the first pivotal point when the chair frame is unfolded.

16. A chair frame of a foldable chair, comprising:

left and right side frames at left and right sides of the chair frame, each comprising:

a rear leg having an upper end;

a backrest rod having a lower end pivotally connected to the rear leg at a fixed first pivotal point below the upper end of the rear leg when the chair frame is unfolded;

a connecting piece disposed on the backrest rod and movable along the backrest rod;

a seat rod having a rear end pivotally connected to the rear leg at a fixed second pivotal point below the upper end of the rear leg when the chair frame is unfolded;

a front leg having an upper end pivotally connected to the connecting piece and a middle portion pivotally connected to the seat rod at a third pivotal point, wherein when the chair frame is unfolded, an upper portion of the front leg between the upper end of the front leg and the third pivotal point abuts the upper end of the rear leg;

a pair of cross front supporting rods disposed between the left and right side frames at a front side of the chair frame, wherein each front supporting rod has a lower end pivotally connected to a lower portion of the front leg of one side frame, and an upper portion pivotally connected to a front portion of the seat rod of the other side frame at a fourth pivotal point and a pair of cross rear supporting rods disposed between the left and right side frames at a rear side of the chair frame, wherein each rear supporting rod has a lower end pivotally connected to a lower portion of the rear leg of one side frame and an upper end pivotally connected to the upper end of the front leg of the other side frame, wherein when the chair frame is unfolded, the upper portion of each front supporting rod extends upward, outward, or upward and outward, beyond the fourth pivotal point, the extended upper portion configured to couple with an armrest cloth to serve as an armrest.

* * * * *